US006981907B1

(12) United States Patent
Korinek et al.

(10) Patent No.: US 6,981,907 B1
(45) Date of Patent: Jan. 3, 2006

(54) HIGH ANGLE GRINDER

(75) Inventors: Richard Korinek, Johnson, KS (US); Victor Jaugilas, Kansas City, KS (US); William G. Walls, Leavenworth, KS (US)

(73) Assignee: RailWorks Corporation, New York, NY (US)

( * ) Notice: Subject to any disclaimer, the term of this patent is extended or adjusted under 35 U.S.C. 154(b) by 0 days.

(21) Appl. No.: 10/980,409

(22) Filed: Nov. 3, 2004

(51) Int. Cl.
*B24B 1/00* (2006.01)

(52) U.S. Cl. ..... 451/5; 451/58; 451/63; 451/139; 451/174; 451/280; 451/347

(58) Field of Classification Search ..... 451/5, 451/63, 58, 139, 174, 280, 347, 429; 409/175
See application file for complete search history.

(56) References Cited

U.S. PATENT DOCUMENTS

| | | | | |
|---|---|---|---|---|
| 4,178,724 | A | 12/1979 | Bruno | |
| 4,249,346 | A | 2/1981 | Theurer et al. | |
| 4,347,688 | A | 9/1982 | Scheuchzer et al. | |
| 4,492,059 | A * | 1/1985 | Panetti | 451/347 |
| 4,583,327 | A | 4/1986 | Jaeggi | |
| 4,596,092 | A * | 6/1986 | Panetti | 451/347 |
| 4,622,781 | A | 11/1986 | Vieau et al. | |
| 4,779,384 | A | 10/1988 | Shoenhair et al. | |
| 4,785,589 | A | 11/1988 | Buhler | |
| 4,843,765 | A * | 7/1989 | Panetti | 451/347 |
| 4,862,647 | A * | 9/1989 | Vieau | 451/347 |
| 5,111,624 | A | 5/1992 | Shoenhair et al. | |
| 5,253,830 | A * | 10/1993 | Nayer et al. | 246/220 |
| 5,359,815 | A | 11/1994 | Schrunk, III et al. | |
| 5,567,196 | A | 10/1996 | Theurer | |
| 5,575,709 | A | 11/1996 | Hertelendi et al. | |
| 5,580,299 | A | 12/1996 | Pomikacsek | |
| 6,033,166 | A * | 3/2000 | Hampel | 409/175 |
| 6,033,291 | A | 3/2000 | Mathison et al. | |
| 6,358,140 | B1 | 3/2002 | Hempel | |

* cited by examiner

*Primary Examiner*—George Nguyen
(74) *Attorney, Agent, or Firm*—Buchanan Ingersoll PC

(57) ABSTRACT

One or more high angle grinding units are supported by a carriage mountable on the underside of a rail grinding vehicle. Each grinding unit is attached to the carriage in a manner enabling controllable movement of the grinding units laterally, vertically, and angularly, with respect to the rails, so that a grinding stone rotated by the grinding unit can be operated to grind between a railhead and a closely adjacent rail structure to reform the gauge side of the railhead and the field side of the closely adjacent structure.

25 Claims, 5 Drawing Sheets

HIGH ANGLE GRINDER

BACKGROUND

The invention relates generally to machines for grinding and reforming the surfaces of railroad track rails. More particularly, the invention relates to an apparatus for grinding the railhead in hard to reach areas such as switch points, like frogs, rail ends, and guard rails. These areas are inaccessible by conventional rail grinding cars and require manual grinding operations.

Railroad track rails are subject to wear by the passage of trains over the rails, and the head surfaces of railroad track rails which are in direct contact with the wheels and wheel flanges of rolling stock tend to wear unevenly. In particular, the cross sectional contour of the head can become misshapen, and depressions in the top surface of the railhead may develop such that the railhead presents a modulating, corrugated surface. Moreover, the railhead may develop burrs or otherwise lose its symmetrical profile. Such defects create undesirable vibration, particularly at high speeds, and also produce high noise levels. Maintenance of smooth running surfaces on railroad track rails is therefore important for reasons of safety, riding comfort, protection of the track, track bed and rolling stock, and noise suppression.

Grinding machines have been developed for maintaining railroad track rails in smooth, properly shaped condition. Such grinding machines generally comprise a plurality of rotatable grinding modules carried by a locomotive or the like in close proximity to the railhead surfaces of the track rail. The grinding modules include rotatable, abrasive grinding stones that can be lowered into a position flush with the rail surface to grind and restore the rail surface to a smooth, desired profile. In particular, on-track grinding trains carrying arrays of heavy grinding stones driven by powerful motors have been used in such grinding operations. An example of such a rail grinding car is disclosed in U.S. Pat. No. 4,583,327, in which there is described a rail grinding car having vertical and horizontal grinding stone units. Horizontal grinding stones are generally annular with a flat, annular face being the grinding surface, whereas vertical grinding stones grind with an outer cylindrical surface of the stone. This grinding car embodies positioning control of an array of vertical grinding stones so that each stone properly engages the rail, and wherein the horizontal grinding stones are individually positionable to provide flexibility in grinding location and concentration on the railheads.

A rail grinding device having active spark control is described in applicants copending U.S. patent application Ser. No. 10/894,198, filed Jul. 19, 2004, which is hereby incorporated herein by reference.

Some grinding machines are specialized to enable them to grind some switch and crossing areas, which are inherently more difficult due to shorter turns, elevation changes and various guardrails. However, some portions of these switch and crossing areas are not capable of being ground by existing automated methods because of the close proximity of frogs, switch rail ends, guardrails, and the like, to the gauge side of the railhead, which prevents conventional grinding units from forming a complete profile. For example, projecting or protruding metal that develops on the field side of switch points and the gauge portion of the stock rail cannot be removed by conventional cup grinders. This projecting metal can become substantial enough that it can hold the point slight open or away from the stock rail. Left uncorrected this can increase the likelihood of a wheel flange selecting the incorrect support rail, which can cause a derail.

Such areas can require a separate procedure, usually involving a self-powered, manually controlled grinder. Commonly, a manual grinder is transported to the area of operation by a separate vehicle, unloaded and carried to the track, where it is attached and operated. The procedure is reversed upon completion of the grinding operation and repeated as necessary as other switches and crossings are encountered. Loading and carrying requires two people, attachment and operation requires one.

Manual, hand-held hydraulically operated grinders are known which are used to grind such areas of the rails, e.g., switch point, frogs, rail ends and the like. These areas would primarily require freehand grinding in which the operator would be put in a bent over position. U.S. Pat. Nos. 3,974,597 and 4,751,794 describe an apparatus for grinding a base of a railroad rail, but not a head of a rail and, and cannot be easily used in tight areas that would otherwise need freehand grinding with a hand-held grinder.

U.S. Pat. No. 6,358,140 describes a grinder support apparatus for supporting a manual grinder, including a conventional hand-held grinder, on a railhead for performing these grinding operations in a safer, more convenient manner. The grinder support apparatus in this patent is described as including a frame having a support wheel adapted to roll on a top surface of the railhead, a handle for a user to move the support wheel and frame along the rail, and a support section for removably connecting the grinder to the frame in a position wherein the grinding wheel of the grinder is held against the surface of the railhead. This device may provide a safer, more convenient manner for individuals to carrying out such grinding operations with manually operated grinders.

However, it would be more desirable to have a rail grinding apparatus which could be used with a rail grinding car to enable the grinding of switch points, frogs, rail ends and like areas of railroad rail tracks which would otherwise require manual grinding, such as by the MC3 crews mentioned previously.

There is a perceived need within the industry for a more efficient method of maintaining hard-to-reach rail profiles than present methods, which include operator controlled grinding with awkward, cumbersome machinery and its associated logistics and personnel requirements.

SUMMARY

A high angle grinding apparatus for a rail grinding vehicle is provided wherein one or more high angle grinding units are supported by a carriage mountable on the underside of a rail grinding vehicle. The high angle grinding apparatus enables the automated grinding of the gauge side of train rails in dimensionally restricted environments, such as switches and crossings, where automated grinding by conventional undercarriage rail grinding units is precluded.

The high angle grinding apparatus can comprise each grinding unit being attached to the carriage in a manner enabling controllable movement of the grinding units laterally, vertically, and angularly, with respect to the rails, so that a grinding stone rotated by the grinding unit can be operated to grind between a railhead and a closely adjacent rail structure to reform the gauge side of the railhead and the field side of the closely adjacent structure. A grinding unit position controller, for example a computer, can preferably be provided to control the overall positioning of the grinding stone relative to the railhead and closely adjacent rail structure.

The apparatus can further comprise the carriage being mountable on the underside of the rail grinding vehicle such that the carriage is suspended over rails on which the rail grinding vehicle travels. A grinding stone is rotatably attached each grinding unit, and the grinding stone can having grinding surfaces on each side thereof, such that one side of the grinding stone can be positioned to grind the gauge side of the railhead and the opposite side can be positioned to grind the field side of the adjacent rail structure. The grinding stone be a relatively narrow and have a comparatively large diameter.

The grinding apparatus can further comprise a framework slidably connected to the carriage, wherein the framework is laterally movable relative to the carriage, and the grinding unit can be connected to the framework in a manner enabling controlled movement of the grinding unit vertically and angularly relative to the framework.

A lateral position control member can be connected between the carriage and the framework, wherein the lateral position control member is controllable to move the framework and thus the grinding unit laterally to a desired lateral position. A lateral position sensor can be provided associated with the lateral position control member. The lateral position sensor detects the lateral position of the grinding unit relative to the rails, and can provide corresponding feedback to the grinding unit position controller. The lateral position control member can be an extendable length member having one end connected to the framework and an opposite end connected to a fixed structure, such as, for example, a portion of the carriage whereby extension and contraction of the member controls the lateral position of the framework, and thus the grinding unit. The lateral position control member can be, for example, a hydraulic, electric, or pneumatic cylinder.

The grinding apparatus can further comprise a mounting bracket movably connected to the framework, wherein the mounting bracket can be movable vertically relative to the framework. The grinding unit can be connected to the mounting bracket in a manner enabling movement of the grinding unit angularly relative to the mounting bracket. To accomplish the vertical mobility, upper and lower pairs of parallel arms can be provided connecting the mounting bracket to the framework. Opposite ends of each of the pair of upper and lower parallel arms can be pivotally connected between the mounting bracket and the framework such that movement of the upper and lower parallel arms, which move together, about the pivotal connection to the framework causes the grinding unit to move vertically relative to the framework, and thus also the rails.

A vertical position control member can be provided, and can be connected between the mounting bracket and at least one of the pairs of upper and lower parallel arms. The vertical position control member can be operated to rotate at least one of the upper and lower parallel arms, which moves both pairs of upper and lower parallel arms since they are all connect to both the mounting bracket and the framework. If one moves, the others are constrained to move also. In this way, the mounting bracket, and thus the grinding unit, can be moved to a desired vertical position. A vertical position sensor can be provided associated with the vertical position control member, wherein the vertical position sensor detects a vertical position of the grinding unit relative to the rails and provides feedback, corresponding to the vertical position, to the grinding unit position controller.

The vertical position control member can be an extendable length member having one end connected to the mounting bracket and an opposite end connected to one of the upper and lower parallel arms, whereby extension and contraction of the member controls the vertical position of the mounting bracket, and thus the grinding unit attached thereto. The vertical position control member can be, for example, a hydraulic, electric, or pneumatic cylinder.

The grinding can further comprise a tilt housing connected to an end of the grinding unit at which the grinding stone is rotatably connected. The mounting bracket can include a pair of downwardly extending arms which can be rotatably attached to pivot points projection from ends of the tilt housing, such that the tilt housing, and thus the grinding stone, is rotatable relative to the mounting bracket. An angular rotation linkage can be provided, having an upper end connected to the mounting bracket and a lower end connected to the tilt housing, wherein the angular rotation linkage is operable to rotate the tilt housing, and thus the grinding stone, relative to the mounting bracket, and thus also the rails.

To operate the angular rotation linkage, an angular position control member can be provided connected between the mounting bracket, or other fixed structure, and the angular rotation linkage. The angular position control member is controllable to operate the angular rotation linkage to rotate the tilt housing, and thus the grinding unit, to a desired angular position relative to the rails. An angular position sensor can also be provided associated with the angular position control member for detecting an angular position of the grinding unit relative to the rails. Feedback from the angular position sensor corresponding to the angular position of the grinding unit can be provided to the grinding unit position controller.

The angular position control member can be an extendable length member connected as described above, such that extension and contraction of the member controls the angular position of the tilt housing, and thus the grinding unit. The angular position control member can be, for example, a hydraulic, electric, or pneumatic cylinder.

Further details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings in which.

DETAILED DESCRIPTION

To better understand the invention, it is helpful to first understand conventional rail grinding procedures and equipment. The function of rail grinding operations is to grind the surface of the railhead to remove imperfections and reform the shape of the railhead to reduce rolling friction and vibration. The reduction in friction and vibration result in reduced operating costs, increased passenger comfort, and higher operating speeds.

Figure 1:
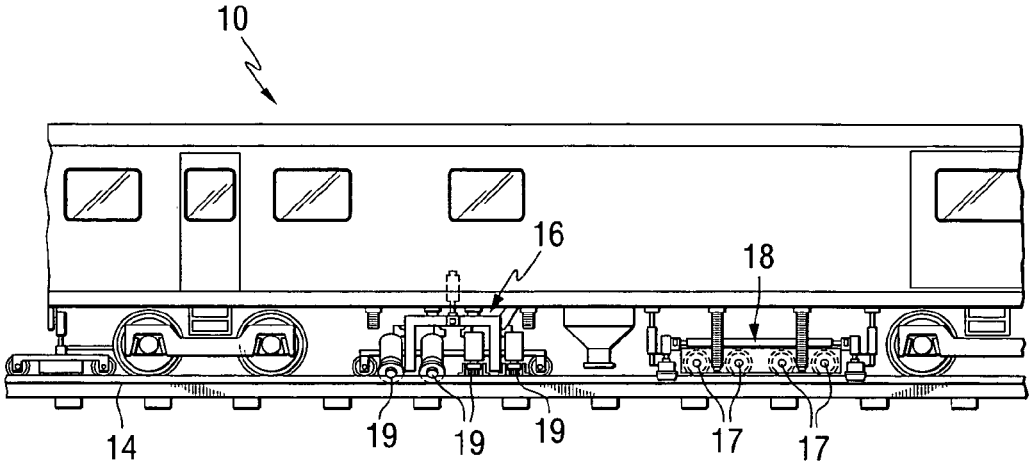
FIG. 1 PRIOR ART
FIG. 1 is a prior art type rail grinding car.

FIG. 1 corresponds to FIG. 1 of U.S. Pat. No. 4,583,327, described previously, which shows a prior art rail grinding car 10 that travels along rails 14 which are to be resurfaced by multiple grinding units 17, 19, suspended from the underside of the grinding car 10. This conventional rail grinding car 10 carries two types of grinding units, vertical grinders 17 and horizontal grinders 19. Each type of grinding unit 17, 19 includes a motor driven grinding stone which is positioned against the railhead 14 at an angle designed to grind the railhead 14 to have a desired surface configuration and/or smoothness. Each grinding unit 17, 19 is supported on sub-frames 18, 16, respectively, carried on the underside of the rail grinding car 10.

The vertical grinding stones 17 and horizontal grinding stones 19 are not positionable between the rails 14 and any closely adjacent rail structure. As can be seen best in FIGS. 4–7 of U.S. Pat. No. 4,583,327, the vertical grinding stones 17 grind the top of the rails, and the thin edge of the grinding stone 17 is the grinding surface, rather than the sides thereof. As shown best in FIGS. 8–9 of U.S. Pat. No. 4,583,327, the horizontal grinding stones 19 can grind the gauge and field sides of the rails in addition to the top surface. The horizontal grinding stones 19 have a single grinding face which grinds the rail. The vertical grinding stones 17 and the horizontal grinding stones 19 are not positionable between the rail and any closely adjacent rail structures.

Accordingly, the conventional grinding units 17, 19 on the rail grinding vehicle 10 in U.S. Pat. No. 4,583,327 are not capable of grinding the rails in dimensionally restrictive railway zones, such as switch and crossing areas, because of the close proximity of the gauge side of the railhead to closely adjacent structures, such as switch points, frogs, rail ends, guard rails, and the like. Instead, these dimensionally restrictive areas commonly require a separate procedure performed by an MC3 crew, which conventionally involves a self-powered, manually controlled rail grinding device.

Figure 2A:
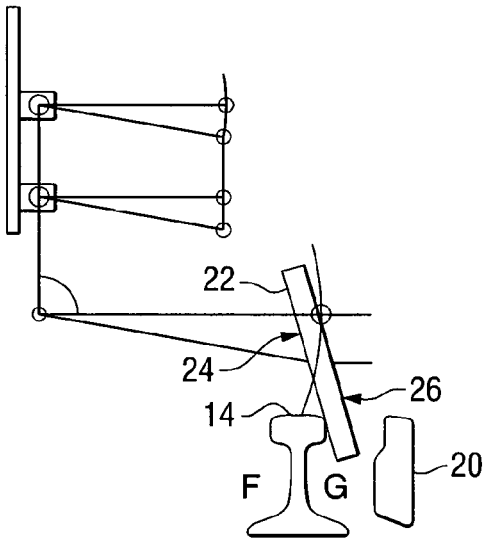
FIGS. 2A and 2B are cross sectional views illustrating the positioning of a grinding stone, according to an embodiment of the invention, relative to a railhead and a closely adjacent rail structure.
Figure 2B:
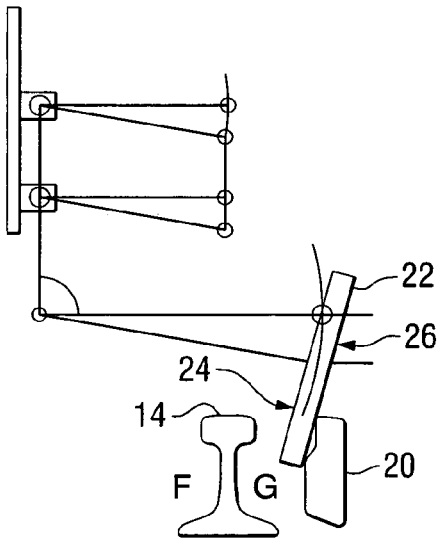
Figure 3:
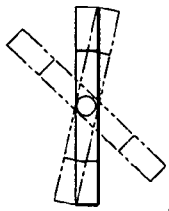
FIG. 3 illustrates a range of annular motion for the grinding stone in FIGS. 2A and 2B, according to an embodiment of the invention.

FIGS. 2A and 2B are cross section views representative of a switch point area, where the railhead 14 is closely adjacent another rail structure, e.g., part of the switch 20. These figures illustrate how a grinding stone 22 of a high angle grinder according to the invention can be positioned between the gauge side (G) of the railhead 14 and the field side (F) of a closely adjacent rail structure 20. The grinding stone 22 can have grinding surfaces on each face 24, 26, or side, of the grinding stone 22. The grinding stone 22 is adjustable laterally, vertically and angularly in order to position the grinding stone to grind both the railhead 14, using one side 24 of the grinding stone 22, and the closely adjacent structure 20, with the opposite side 26 of the grinding stone. The range of angular adjustability of the grinding stone 22 is illustrated in FIG. 3, as an example only, in FIG. 3, and can be, in a preferred embodiment, from about +45 degrees to about +135 degrees.

In comparison, the vertical grinding stones 17 and the horizontal grinding stones 19 of the conventional rail grinding vehicle described in U.S. Pat. No. 4,583,327 do not grind with opposite faces of the grinding stone, and also do not apply force against the grinding stones in opposite directions, as would be needed to grind with opposite faces of the grinding stone.

Figure 4:
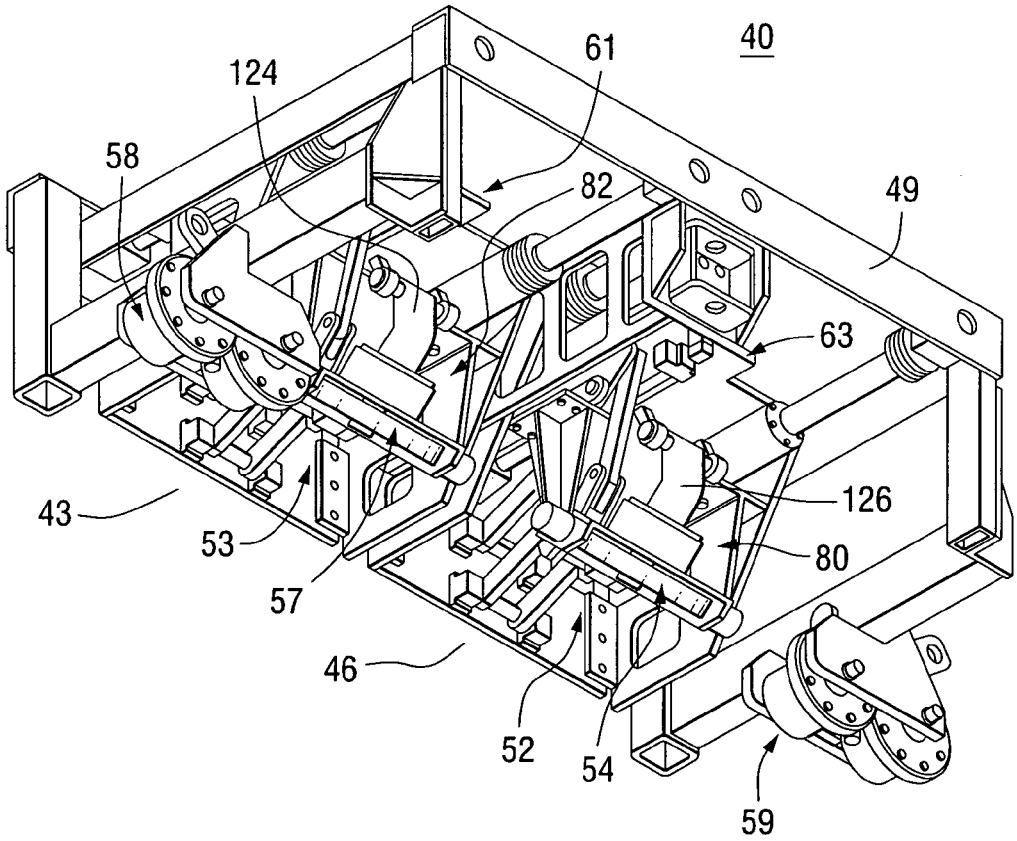
FIG. 4 is a perspective view of an embodiment of the invention in which a pair of high angle grinding units are mounted on a carriage.

FIG. 4 is a perspective view of an embodiment of a rail grinding apparatus 40 according to the invention. A pair of high angle grinder assemblies 43, 46 are shown mounted on a carriage 49, which is designed to be carried on the underside of a rail grinding car, for example a rail grinding car like that shown in FIG. 1. Each high angle grinder assembly 43, 46, for example high angle grinder 46 shown in FIG. 5, can comprise a grinding unit 52 mountable in a manner that permits the grinding unit 52 to be moved laterally, vertically, and angularly relative to the rail grinding vehicle, and thus the railhead 14 and adjacent rail structures 20.

The grinder assembly 43 also includes a grinding unit 53, and the grinding units 52 and 53 can be identical. Each grinding unit 52, 53 has a grinding stone 54, 57 rotatably attached to the end of the grinding units so as to be positioned between the gauge side of the railhead 14 and the field side of the closely adjacent rail structure 20. Each side, or face, of the grinding stone, for example grinding stone 54, can have a grinding surface, e.g., opposite grinding faces 55 and 56 (shown in FIGS. 7A and 7C), such that one face 55 of the grinding stone 54 can be positioned to grind the gauge side of the railhead 14 and the opposite face 56 can be positioned to grind the field side of the closely adjacent rail structure 20.

Figure 6:
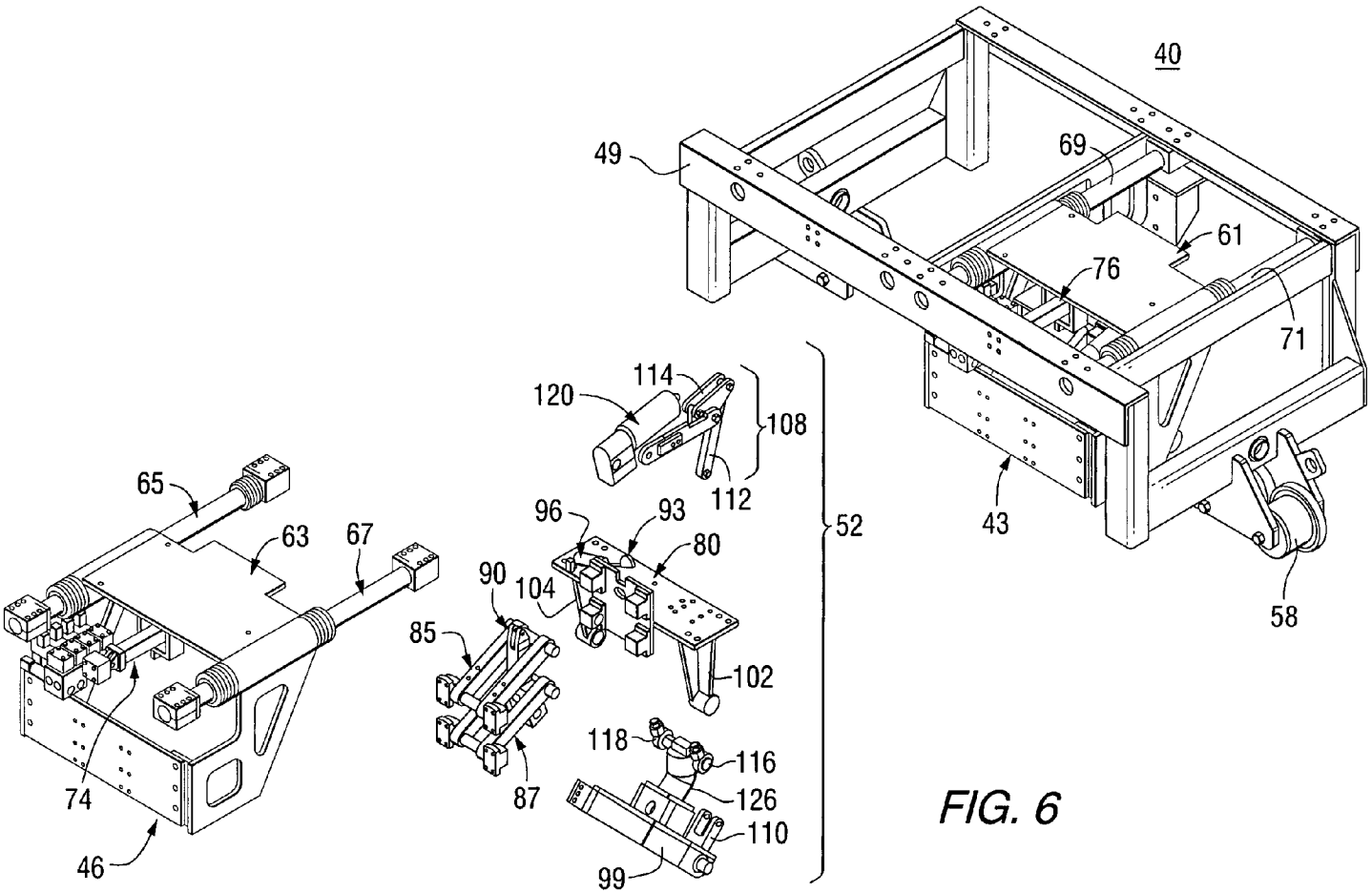
FIG. 6 is an exploded view of the embodiment shown in FIG. 4.

As shown best in FIGS. 4 and 6, the carriage 49 is suspended from the underside of the rail grinding vehicle, such that the carriage 49 is suspended over rails on which the rail grinding vehicle travels. The carriage 49 can be suspended off the rails in a stowed position when the rail grinding vehicle is not grinding the rails. The carriage 49 can have flanged wheels 58, 59 which support the carriage 49 on the rails 14 when lowered to a deployed position at the beginning of a grinding operation. The carriage 49 can be held securely stowed under the rail grinding vehicle, such as via safety latches received in latch hooks (neither shown) while in transit to grinding locations. Carriage lift cylinders (not shown), such as hydraulic cylinders, can be used to lift the carriage 49 to disengage the latches off the latch hooks, and then lower the carriage 49 to the rail 14. The carriage lift cylinders lower the carriage 49 until the flanges of the carriage wheels 58, 59 contact the gauge portion of the rails 14, or, alternatively, until the flange contact a gauge bar set to the maximum spread distance desired.

One or more grinding units 52, 53, and preferably a pair, as shown for example, can be supported by a single carriage 49, and in a manner to enable controlled movement of each grinding assembly 43, 46, laterally, vertically, and angularly relative to the carriage 49, and thus the railhead 14. Also, a plurality of carriages 49 can be carried by the rail grinding vehicle, each having high angle grinders.

Figure 5:
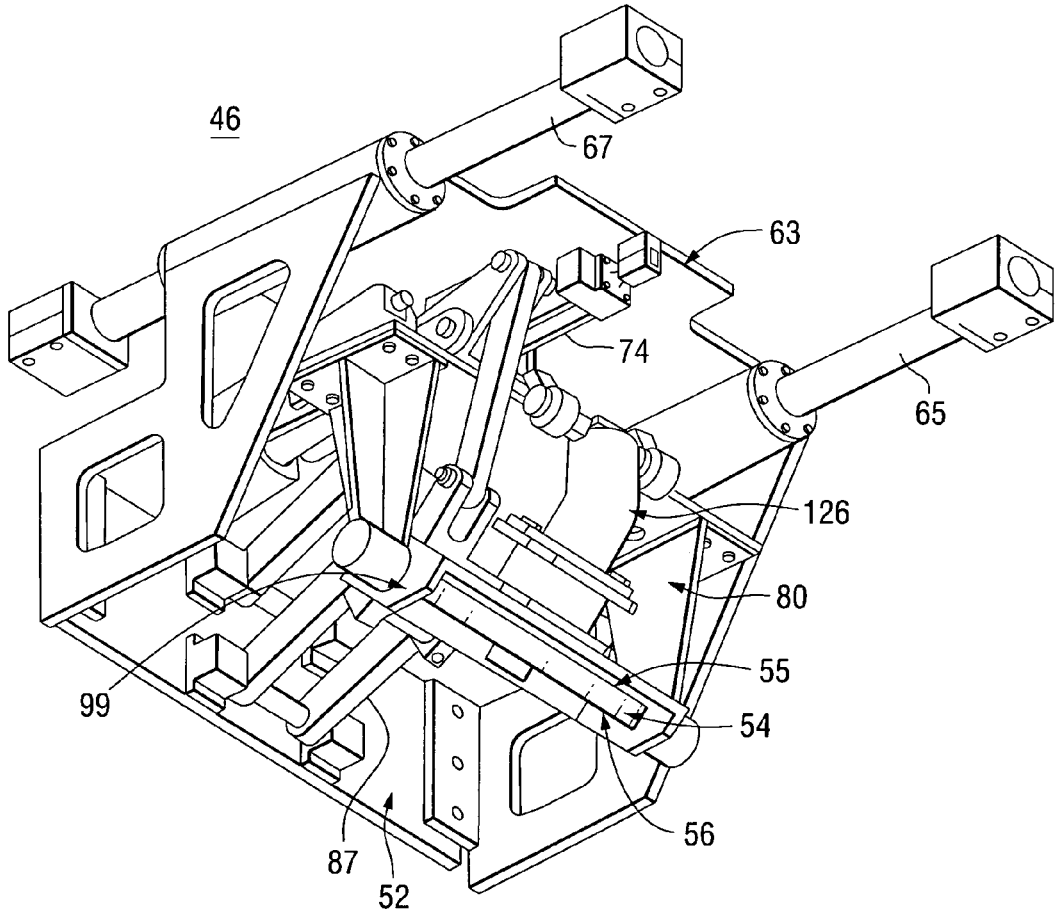
FIG. 5 is a perspective view an embodiment of one of the high angle grinding units in FIG. 4 removed from the carriage.

As seen best in FIGS. 5 and 6, cross-slide framework 61, 63 can be slidably connected to the carriage 49 such that each framework 61, 63 is controllably slidable laterally relative to the carriage 49. Each cross-slide framework 61, 63 is slidably connected to the carriage 49, via, for example, a pair of parallel guide bars 65, 67 and 69, 71. Each grinding unit 52, 53 is connected to a respective cross-slide framework 61, 63, and is thus movable laterally relative to the railhead 14 via the slidable movement of the framework 61, 63 relative to the carriage 49. Each grinding unit 52, 53 is also connected to the cross-slide framework 61, 63 in a manner to permit vertical and angular adjustability of each grinding unit 52, 53 relative to a respective framework 61, 63.

A lateral position actuator 74, 76 is provided connected between each cross-slide framework 61, 63 and the carriage 49. As shown, for example, each lateral position actuator 74 can be a horizontally mounted extendable (and retractable) cylinder. The actuator 74 can have one end connected to the carriage 49 and an opposite end attached to a respective cross-slide framework 61, 63. In this way, changes in the length of the horizontal cylinder cause the framework 61, 63 to slide laterally along the parallel guide bars 65–71, thus moving the framework 61, 63 laterally relative to the carriage 49. The lateral position actuator 74, 76 can be, for example, a hydraulic, electric, or pneumatic cylinder.

FIG. 6 best illustrates that a mounting bracket 80, 82 can be connected to each cross-slide framework 61, 63 in a manner which enables the mounting bracket 80 to be controllably movable vertically relative to the framework 61, 63. Each grinding unit 52, 53 is attached to a respective mounting bracket 80, 82, and is thus movable vertically relative the railhead 14, via the vertical movement of the mounting bracket 80, 82 relative to the framework 61, 63. Each grinding unit 52, 53 is also connected to the mounting bracket 80, 82 in a manner to permit controllable angular adjustment of each grinding unit 52, 53 relative to each mounting bracket 80, 82. More particularly, for example, an arrangement of upper 85 and lower 87 pairs of parallel arms can be employed to connect the mounting bracket 80 to the framework 63 to enable the controllable vertical movement.

Since each grinding assembly 43, 46 can have identical structure, generally only the structure of grinding assembly 46 will be described in detail hereinafter. Each end of the upper 85 and lower 87 pairs of parallel arms is pivotally connected between the mounting bracket 80 and the framework 63. In this manner, rotation of the upper 85 and/or lower 87 parallel arms about the pivotal connections of the mounting bracket 80 to the framework 63 will cause the mounting bracket 80, and thus the grinding unit 52, to move vertically relative to the framework 63.

To activate the vertical adjustment, a vertical position actuator 90 can be connected between, for example, one of the pair parallel arms 85, 87 and a fixed structure, such as, for example, part of the cross-slide framework 63. As shown, by way of example, the vertical position actuator 90 can comprise a vertically mounted extendable (and retractable) cylinder. A lower end of the cylinder can be connected to, for example, the lower pair 87 of parallel arms, and an upper end of the cylinder can be attached to the cross-slide framework 63. In this way, changes in the length of the vertical actuator 90 cause the lower pair 87 of parallel arms to rotate (and the upper pair 85 of parallel arms are constrained to move also), thus moving the mounting bracket 80 vertically relative to the framework 63. The vertical position actuator 90 can be, for example, a hydraulic, electric, or pneumatic cylinder.

A grinding unit latch 93 can be provided to secure the grinding unit 52 in a vertically raised position, such as when the carriage 49 is stowed under the rail vehicle during transit. The latch 93 can cooperate with a, for example, a latch hook (not shown), which can be provided on, for example, the mounting bracket 80. Alternatively, the latch hook could be provided on the framework 63 or the carriage 49. To deploy the grinding unit 52, the vertical positioning actuator 90 can be operated to slightly raise the grinding unit 52, and a latch release cylinder 96 can be triggered to disengage the latch 93 from the latch hook. The grinding unit 52 can then be lowered below the latch hook to the desired vertical position.

Figure 7B:
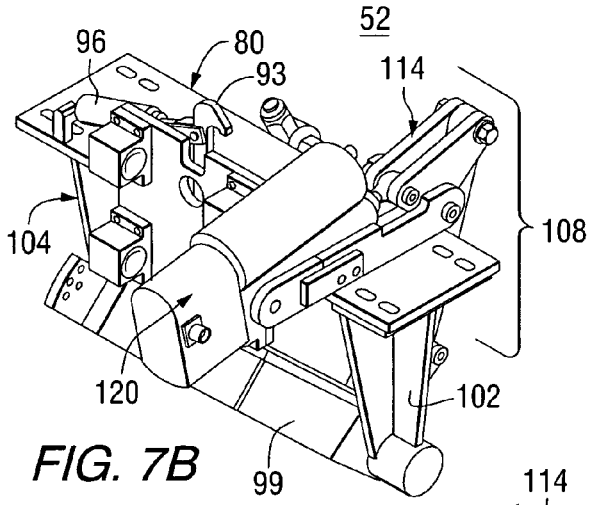
FIGS. 7A, 7B and 7C are perspective views at multiple angles of an embodiment of a high angle grinding unit.
Figure 7C:
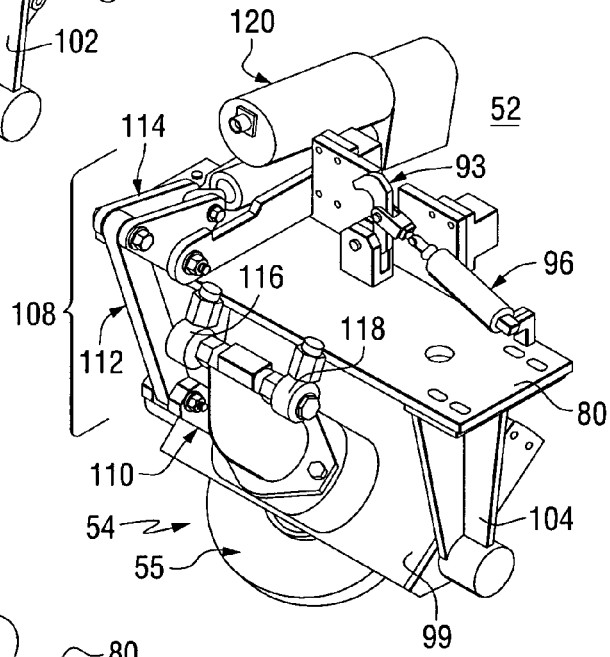
Figure 7A:
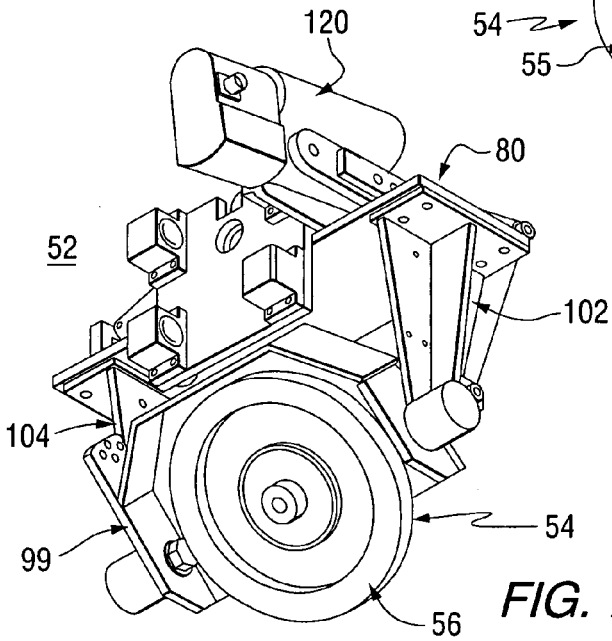

The angular adjustability of the grinding unit 52 relative to the mounting bracket 80 can be provided as shown best in FIGS. 7A–7C. As shown, a tilt housing 99 can be provided at the end of the grinding unit 52 to which the grinding stone 54 is attached. A pair of vertical grinder support arms 102, 104 can extend downwardly from the mounting bracket 80 and can be rotatably attached to opposite sides of the tilt housing 99 using, for example, angle pivot bearings. Additionally, an angular rotation linkage 108 can be attached between the mounting bracket 80 and a portion of the tilt housing 99, such that operation of the angular rotation linkage 108 causes the tilt housing 99, and thus the grinding stone 54, to rotate relative to the mounting bracket 80, and thus the railhead 14. More particularly, for example, the angular rotation linkage 108 can include an angle actuation control arm 110 attached to the tilt housing 99, an angle actuation push rod 112, and an angle actuation bell crank 114. The angle actuation bell crank 114 can be triangular shaped, with a middle leg of the triangle rotatably connected to the mounting bracket 80. The angle actuation push rod 112 has one end rotatably connected a second leg of the bell crank 114, and an opposite end rotatably connected to the angle actuation control arm 110, such that rotation of the bell crank 114 about the middle leg connection to the mounting bracket 80 will cause the push rod 112, in conjunction with the angle actuation arm 110, to rotate the tilt housing relative to the support arms. At the end of the grinding unit 52 opposite the grinding stone 54, swivels 116, 118 (for example hydraulic swivels) can be provided. The hydraulic swivels 116, 118 are attached to the mounting bracket 80 to support and facilitate the angular rotation of the grinding unit 52 relative to the mounting bracket 80.

To control the angular positioning of the grinding stone 54, an angular position actuator 120 can be provided, which can have one end connected to a third leg of the angle actuation bell crank 114. The angular position actuator 120 can thus operate the angular rotation linkage 108 by rotating the bell crank 114 to cause the tilt housing 99, and thus the grinding stone 54, to rotate relative to the mounting bracket 80. Like the vertical position actuator 90, for example, the angular position actuator 120 can comprise an extendable/retractable cylinder having one end fixed to the mounting bracket 80 and the opposite end connected to the third leg of the angle actuation bell crank 114. In this way, changes in the length of the cylinder rotate the bell crank 114, causing the push rod 112 to rotate the tilt housing 99 relative to the mounting bracket 80, and thus the railhead 114. As with preceding actuators, the angular position actuator 120 can also be, for example, a hydraulic, electric, or pneumatic cylinder.

The preceding description sets forth certain details of an embodiment of the invention for controlling the movement of each grinding unit laterally, vertically, and angularly. As described above in detail with respect to grinding unit 52, separate actuators can be employed to effect the movement of each grinding unit laterally, vertically and angularly. In addition to these individual actuators, an overall grinding unit position controller, such as a computer (not shown) on board the rail grinding vehicle can be provided to control each actuator and automatically position each grinding units in a desired position to grind the railhead 14, and the closely adjacent rail structure 20. For example, the overall position controller can control each of the lateral 74, vertical 90 and angular 120 actuators described above to move the grinding unit 52 to the desired position. The operation of the overall controller can be facilitated by providing information corresponding to the lateral, vertical and angular position of the grinding unit 52. To provide this feedback, sensors, such as, for example, linear feedback devices, can be provided associated with each of the lateral 74, vertical 90 and angular 120 positioning actuators. The linear feedback devices (not visible) can be of a conventional type and can be part of, e.g., incorporated into, each actuator. The position sensors provide feedback corresponding to the lateral, vertical and angular position of the grinding unit 52 to the overall position controller for use in controlling the positioning cylinders 74, 90, 120 to properly position the grinding unit 52. In the case of the angular positioning actuator 120, the linear feedback (in terms of the linear extension of the cylinder) can be correlated, such as using algorithms, to the angular movement of the grinding stone 54, e.g. via the dimensions of the bell crank 114, the angle between the legs, etc., and to determine the resulting vertical and horizontal position of the grinding stone 54.

Each grinding stone 54, 57 can preferably be a relatively narrow stone with a comparatively large diameter. In a presently preferred embodiment, each high angle grinding stone 54, 57 can be two-sided, have a 12 inch diameter and be about 1¾ inch thick. The grinding stones 54, 57 can be driven by a hydraulic motor 124, 126 at, for example, about 3,200 rpm.

According to the invention, a method of grinding the gauge side of a railhead 14 and a closely adjacent rail structure 20, in areas such as switch points, for example, can comprise the steps of mounting a grinding unit, for example grinding unit 52, on a rail grinding vehicle, positioning a rotatable grinding stone 54 portion of the grinding unit 52 between the railhead 14 and the closely adjacent rail structure 20 by controlling lateral, vertical and angular positioning of the grinding unit 52, grinding the railhead 14 using a first grinding surface 55 on one side of the grinding stone 54, and grinding the closely adjacent rail structure 20 using a second grinding surface 56 on an opposite side of the grinding stone 54.

Additional steps for providing the lateral, vertical and angular positioning can comprise the following general, and more specific, steps: (1) mounting a carriage 49 on an underside of the rail grinding vehicle, connecting a grinding assembly 46 to the carriage 49, wherein the grinding assembly 46 is movable laterally, vertically, and angularly relative to the carriage 49; (2) slidably connecting a framework 63 to the carriage 49, connecting a grinding unit 52 to the framework 63, wherein the grinding unit 52 is movable vertically and angularly relative to the framework 63; (3) connecting a mounting bracket 80 to the framework 63, wherein the mounting bracket 80, and thus the grinding unit 52, is movable vertically relative to the framework 63; and (4) connecting the grinding unit 52 to the mounting bracket 80, wherein the grinding unit 52 is movable angularly relative to the mounting bracket 80.

Further steps for enabling the vertical movement can comprise pivotally connecting upper 85 and lower 87 pairs of parallel arms between the mounting bracket 80 and the framework 63, and pivoting the upper 85 and lower 87 parallel arms relative to the framework 63 to vertically position the grinding unit 52.

Further steps for enabling the angular movement can comprise connecting a tilt housing 99 at an end of the grinding unit 52 at which a grinding stone 54 is attached, rotatably connecting the tilt housing 99 to the mounting bracket 80, and rotating the tilt housing 99 relative to the mounting bracket 80 to angularly position the grinding stone 54.

The method can also include controlling the overall position of the grinding unit 52 using a central, overall position controller. Particular steps according to the invention can comprise sensing lateral, vertical and angular position of the grinding unit 52, using feedback corresponding to each position to control the lateral positioning of the grinding unit 52.

The control over the lateral, vertical and angular position, i.e., providing such movement, can be accomplished using, for example, the structures and actuators, 74, 90, 120 described previously, as shown in the drawing figures.

The method contemplates using a relatively narrow grinding stone 54 having a comparatively large diameter, so that the grinding stone 54 is sized and shaped to facilitate positioning between the gauge side of the railhead 14 and the field side of the closely adjacent rail structure 20 in areas such as, for example, switch points. The invention also contemplates utilizing a pair of grinding units 52, 53 connected to each carriage 49, wherein each of the pair of grinding units 52, 53 is movable laterally, vertically, and angularly relative to the carriage 49. Also, more than one carriage 49, and associated grinding units 52, 53, can be carried by the rail grinding vehicle.

Operation of the High Angle Grinding Assembly

One or more carriages 49 can be stowed under the frame of a rail grinding vehicle during transit. When the grinding location is arrived at, carriage lift cylinders (not shown) can lower the carriages until the flanges of the carriage wheels contact the gauge portion of the rails, or, alternatively, until the flange contact a gauge bar set to the maximum spread distance desired. The cross-slide guide bars maintain the carriages in a level plane across the top of the rail.

As in conventional rail grinding vehicles, machine operators can be seated at a control console of an overall control system, which can include the aforementioned computer, or a central processor (not shown). The control console can typically be located in the middle of the rail grinding vehicle. The control consol can control the overall grinding unit positioning and sensor systems, used to properly position the grinding stones. The operators can view a monitor, and commonly two monitors, connected to "Bombsite Cameras" (not shown) which are typically attached, for example, at the each end of the rail grinding car, to record the operation of the grinding units that allow the operator to designate the areas or rail features to be ground. Each monitor can have a line across the tracks on the display screens. The distance from a reference point on the machine to this line, as well as the distance from each of the high angle grinding stones to the reference points, can be stored in a PLC register, which can be part of computer or central processor. An encoder, or "coder" (not shown), such as an electronic digital encoder, can be connected to the drag axle of the rail grinding vehicle and can provide a very accurate indication of where each discrete position is located linearly from any grinding targets designated by a machine operator.

Once the carriage is positioned and the grinding units are un-stowed, or deployed, and started, the operator is ready to begin the grinding operation. The operator selects, from a database of stored patterns in the computer or central processor, a grinding pattern having the proper angle, depth, and direction of grind (gauge or field). The operator also verifies that the PLC has set the grinding stone position properly. The depth and lateral position of the grinding stone face to rail contact is substantially affected by the angle at which the grinding stone is positioned. The PLC can have a built-in algorithm to calculate these variances and eliminate operator workload.

While the grinder begins moving through an area in which the railhead is to be ground, the operator activates an "enable" command using the control console. The enable command causes the positioning control system to position the high angle grinding stones near the top of the rail and just inside the gauge face of the rail. Using the monitors, and via the bombsite cameras, when the operator sees the "start of grind" point touch the line on the monitor, a "high angle grind" command is activated. In response to this command, the PLC stores the corresponding encoder location as the "start of grind" location. The same procedure is used to designate and store an "end of grind" location.

On subsequent grinding passes over the rails, the PLC will detect when the grinding stone is a predetermined distance, for example, a few feet, away from the previously stored "start of grind" location. When this is detected, the grinding stone is lowered into position below the top of the rail. Then, when the PLC further detects that the grinding stone is at a closer predetermined distance from the start of grind location, the lateral positioning cylinder is activated to urge the grinding stone against the rail. The lateral force applied by the lateral positioning cylinder to press the grinding stone against the railhead is controlled by the PLC. On such subsequent grinding passes, the vertical and angular positions of the grinding stone can be maintained the same as the initial pass, and the lateral positioning cylinder can be used to move the grinding stone away from the railhead at the end of grind point, and back against the railhead when the pass is repeated. In some grinding operations, there may be three or four grinding passes made at a switch point. The grinding operation is designed to be able to replicate a grinding pass within a couple of inches, since multiple grinding passes may need to be made to achieve the desired results. Under the control of the PLC, the grinding units can be raised and lowered automatically, so the operator doesn't have to control this parameter.

As described previously, all of the position actuators can have associated sensors, for example, linear feedback devices, which can provide feedback to the PLC via, for example, analog input cards. When the PLC detects that individual grinding stones are within a preset distance of the designated grinding zones, the PLC positions the grinding stones laterally and vertically within a fraction of an inch of the railhead, or closely adjacent rail structure, e.g., a switch point. When the grind start point is the proper distance from the desired contact point (based on response time and speed) the PLC directs the grinding stones against the railhead and the grinding process begins. When the "end of grind point" is the proper anticipation distance from the grinding stones, the PLC directs the withdraw of the grinding stones laterally away from the rail, and then lifts the grinding stones back to the ready position. Position and force are constantly controlled by the PLC and accommodation is made for lateral position due to stone wear.

Controlling the vertical position of the high angle grinding stone, to direct the stone down below the top of the rail a set amount, is very important. Additionally, the grinding stone must be horizontally adjustable to apply force either toward the field side of the rail, to grind the gauge side of the rail (between the rail and the switch point), or in the opposite direction, toward the field side of the switch point, in order to grind the outside of the switch point.

Therefore, the grinding stones must be controlled vertically and horizontally, and to apply force in opposite directions, e.g., to field or to gauge. Depth control is also very important. For example, the "frogs" (which look like a cross) have a bottom portion, at a certain depth below the top of the rails. Thus, the grinding process must be controlled so as not to drive the grinding stone to deep, so as to avoid grinding the bottom of the frog. The grinding stone must be positioned to grind along the sides of the rails/switch points without touching the bottom to avoid grooving or scarring the bottom of the frog.

The grinding operation is typically carried out while the rail grinding vehicle is traveling at about 2 or 3 miles per hour, which is roughly 3 to 5 feet per second. The operator is viewing the rails during the grinding operation on the monitors provided by the remotely located cameras. However, the view provided by the cameras is limited because of the swarf and sparks generated by the grinding process. The vision cameras give the operator information he needs to determine the start and end of the grinding zone, but not the condition of the rail or quality of the grind. The computer controls and initially sets the proper grinding angles from rail grinding patterns programmed into the system. However, the operator could detect, from the camera images, if the grinding stones happened to be improperly set out of range, or like aberrations. The operator could detect from the operating screen of the monitors that the stones were not set or operating correctly. However, the operator generally cannot observe those parameters using the bombsite cameras.

When all grinding is completed the motor can be stopped and the vertical positioning cylinders can lift the grinding units into the latch hooks. The carriage latches can be opened and the carriage lift cylinders can lift the carriages back into the stow hooks.

The high angle grinder is typically used to grind angles anywhere from 50° to 135°, wherein 90° is vertical. Overall, the three positioning cylinders enable the desired positioning of the grinding stone against the railhead, and also allow the application of force be applied to press the grinding stone against the railhead in both lateral and vertical directions. Typically about 200 pounds of force is applied to press the grinding stone against the railhead (or the closely adjacent rail structure). Moreover, a force override sensor can be provided which will permit the grinding stone to retract from the railhead in the event obstructions or aberrations are encountered during grinding operations.

The high angle grinding unit according to the invention is basically an extension of an automated control system of a rail grinding vehicle, which enables access by grinding stones to those dimensionally restrictive zones of railway, such as switches and crossings, that were previously unreachable by automated rail grinding units. In particular, the high angle rail grinding units describe herein can be utilized to reshape the gauge side of rails that is otherwise inaccessible to the wider stones commonly used with existing automated grinding systems.

The high angle grinding unit employs a relatively thin grinding stone with a large diameter, rotating on an essentially horizontal axis, to fit between the gauge side of a rail and other track components that would preclude use of ordinary style grinding stones. A system of computer controlled actuators and hydraulic cylinders direct the face of the grinding stone as it shapes the profile of the gauge side of the rail. Thus, the high angle grinding unit enables the automated rail grinding of the entire section of, for example, a switch or crossing, thereby eliminating the need for manual grinders in those situations, and resulting in substantial savings of time, manpower and capital.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention, which should be awarded the full breadth of the following claims and any and all embodiments thereof.

What is claimed is:

1. A high angle grinding apparatus for a rail grinding vehicle, said apparatus comprising:

a. at least one grinding unit mountable to said rail grinding vehicle, said at least one grinding unit movable laterally, vertically, and angularly relative to said rail grinding vehicle; and b. a grinding stone rotatably attached to said at least one grinding unit, said grinding stone positionable between a railhead and a closely adjacent rail structure, said grinding stone having a first grinding surface on first side thereof and a second grinding surface on an opposite side thereof, said first grinding surface positionable to grind said railhead and said second grinding surface positionable to grind said closely adjacent rail structure.

2. The apparatus of claim 1 further comprising:

a. a carriage mountable on an underside of said rail grinding vehicle such that said carriage is suspended over rails on which said rail grinding vehicle travels; and b. said at least one grinding unit supported by said carriage, said at least one grinding unit movable laterally, vertically, and angularly relative to said carriage.

3. The apparatus of claim 2 further comprising:

a. a framework slidably connected to said carriage, said framework laterally movable relative to said carriage; and b. said at least one grinding unit connected to said framework, said at least one grinding unit movable vertically and angularly relative to said framework.

4. The apparatus of claim 3 further comprising:

a. a mounting bracket movably connected to said framework, said mounting bracket movable vertically relative to said framework; and b. said at least one grinding unit connected to said mounting bracket, said at least one grinding unit movable angularly relative to said mounting bracket.

5. The apparatus of claim 4 further comprising:

a. upper and lower pairs of parallel arms each having opposite ends thereof pivotally connected between said mounting bracket and said framework; and b. wherein movement of said upper and lower parallel arms about said pivotal connection to said framework causes said at least one grinding unit to move vertically relative to said framework.

6. The apparatus of claim 4 further comprising:

a. said at least one grinding unit having a first end at which said grinding stone is rotatably connected;

b. a tilt housing connected to said first end of said at least one grinding unit;

c. at least on support arm extending from said mounting bracket to said tilt housing, said at least one support arm rotatably attached to said tilt housing; and d. an angular rotation linkage connected between said tilt housing and said mounting bracket, said angular rotation linkage operable to rotate said tilt housing and relative to said at least one support arm.

7. The apparatus of claim 3 further comprising:

a. a grinding unit position controller which automatically positions said at least one grinding unit in a desired position to grind said rails;

b. a lateral position control member connected between said carriage and said framework, said lateral position control member controllable to move said framework and thus said at least one grinding unit laterally to a desired lateral position; and c. a lateral position sensor associated with said lateral position control member, said lateral position sensor detecting a lateral position of said at least one grinding unit relative to said rails, said lateral position sensor providing feedback, corresponding to said lateral position, to said grinding unit position controller.

8. The apparatus of claim 7 wherein said lateral position control members further comprises one of a hydraulic, electric, and pneumatic cylinder.

9. The apparatus of claim 5 further comprising:

a. a grinding unit position controller which automatically positions said at least one grinding unit in a desired position to grind said rails;

b. a vertical position control member connected between said mounting bracket and at least one of said pairs of upper and lower parallel arms, said vertical position control member controllable to move said mounting bracket and thus said at least one grinding unit to a desired vertical position; and c. a vertical position sensor associated with said vertical position control member, said vertical position sensor detecting a vertical position of said at least one grinding unit relative to said rails, said vertical position sensor providing feedback, corresponding to said vertical position, to said grinding unit position controller.

10. The apparatus of claim 9 wherein said vertical position control members further comprises one of a hydraulic, electric, and pneumatic cylinder.

11. The apparatus of claim 6 further comprising:

a. a grinding unit position controller which automatically positions said at least one grinding unit in a desired position to grind said rails;

b. an angular position control member connected to said angular rotation linkage and said mounting bracket, said angular position control member controllable to operate said angular rotation linkage to rotate said tilt housing and thus said at least one grinding unit to a desired angular position; and c. an angular position sensor associated with said angular position control member, said angular position sensor detecting an angular position of said at least one grinding unit relative to said rails, said angular position sensor providing feedback, corresponding to said angular position, to said grinding unit position controller.

12. The apparatus of claim 11 wherein said angular position control members further comprises one of a hydraulic, electric, and pneumatic cylinder.

13. The apparatus of claim 1 further comprising said grinding stone being relatively narrow and having a comparatively large diameter.

14. The apparatus of claim 2 wherein said at least one grinding units further comprises a pair of said grinding units, both supported by said carriage.

15. A high angle grinding method for grinding a rail head and a closely adjacent rail structure, said method comprising:

a. mounting at least one grinding unit on said rail grinding vehicle;

b. positioning a rotatable grinding stone portion of said at least one grinding unit between said railhead and said closely adjacent rail structure by controlling lateral, vertical and angular positioning of said at least one grinding unit relative to said rail grinding vehicle;

c. grinding said railhead using a first grinding surface on first side of said grinding stone; and d. grinding said closely adjacent rail structure using a second grinding surface on a second side of said grinding stone.

16. The method of claim 15 further comprising:

a. mounting a carriage on an underside of said rail grinding vehicle; and b. connecting said at least one grinding unit to said carriage; and c. wherein said at least one grinding unit is movable laterally, vertically, and angularly relative to said carriage.

17. The apparatus of claim 16 further comprising:

a. slidably connecting a framework to said carriage;

b. connecting said at least one grinding unit to said framework; and c. sliding said framework relative to said carriage to laterally position said at least one grinding unit; and d. wherein said at least one grinding unit is movable vertically and angularly relative to said framework.

18. The method of claim 17 further comprising:

a. connecting a mounting bracket to said framework;

b. wherein said mounting bracket is movable vertically relative to said framework;

c. connecting said at least one grinding unit to said mounting bracket; and d. wherein said at least one grinding unit is movable angularly relative to said mounting bracket.

19. The method of claim 18 further comprising:

a. pivotally connecting upper and lower pairs of parallel arms between said mounting bracket and said framework; and b. pivoting said upper and lower parallel arms relative to said framework to vertically position said at least one grinding unit.

20. The method of claim 18 further comprising:

a. connecting a tilt housing at an end of said at least one grinding unit at which said grinding stone is attached;

b. rotatably connecting said tilt housing to said mounting bracket; and c. rotating said tilt housing relative to said mounting bracket to angularly position said grinding stone.

21. The method of claim 17 further comprising:

a. sensing a lateral position of said grinding unit;

b. using feedback from said sensing to control said lateral positioning of said at least one grinding unit.

22. The method of claim 19 further comprising:

a. sensing a vertical position of said grinding unit;

b. using feedback from said sensing to control said vertical positioning of said at least one grinding unit.

23. The method of claim 20 further comprising:

a. sensing an angular position of said grinding unit;

b. using feedback from said sensing to control said angular positioning of said at least one grinding unit.

24. The method of claim 15 further comprising using a relatively narrow grinding stone having a comparatively large diameter.

25. The method of claim 16 further comprising:

a. connecting a pair of said grinding units to said carriage; and b. wherein each of said pair of grinding unit is movable laterally, vertically, and angularly relative to said carriage.

* * * * *